United States Patent [19]

Pfleger, Sr.

[11] Patent Number: 4,596,107

[45] Date of Patent: Jun. 24, 1986

[54] REJECT MECHANISM FOR BOTTLE CAPPING MACHINE

[76] Inventor: Fred W. Pfleger, Sr., 1152 Barbara Dr., Cherry Hill, N.J. 08003

[21] Appl. No.: 666,331

[22] Filed: Oct. 30, 1984

[51] Int. Cl.[4] ..... B65B 57/00

[52] U.S. Cl. ..... 53/53; 198/370; 209/523; 209/529; 209/606

[58] Field of Search ..... 53/53, 54, 75, 279; 209/523, 529, 597, 606, 925; 198/370, 372, 441

[56] References Cited

U.S. PATENT DOCUMENTS

| | | | |
|---|---|---|---|
| 2,984,337 | 5/1961 | Couch et al. | 198/441 |
| 3,160,277 | 12/1964 | Wyman | 209/523 |
| 3,517,477 | 6/1970 | Thornton | 53/53 |
| 4,467,908 | 8/1984 | Schneider | 198/441 |

FOREIGN PATENT DOCUMENTS

| | | | |
|---|---|---|---|
| 1167210 | 4/1964 | Fed. Rep. of Germany | 53/53 |
| 2848215 | 5/1980 | Fed. Rep. of Germany | 209/523 |

*Primary Examiner*—John Sipos
*Assistant Examiner*—Donald R. Studebaker
*Attorney, Agent, or Firm*—Eugene E. Renz, Jr.

[57] ABSTRACT

High speed system and mechanism for selecting a vial or vials from a series line of vials driven in a given spaced relationship into a capping and sealing mechanism, wherein detection signals are taken in a seal force monitor according to preset criteriae such as bottle configuration and efficiency of capping and sealing, and a vial acceptance or rejection device is operatively tied in to the seal force monitor on a screw feed mechanism, the vials being advanced by a screw feed mechanism into pockets in rotating starwheels, gripper fingers are positioned in conjunction with the starwheel and operable by cam means selectively operated by a signal from the monitor to indicate that a specific vial is to be rejected, the gripper fingers being designed to snap around and hold the vial as long as required, a secondary cam being used to drive the gripper fingers back to a normal inoperative position and/or to release a selected vial to be rejected and deposited into a special path, the secondary cam being further designed and used to include a short movement of the gripper fingers for assuring release of non-selected vials into a selected path for ultimate subsequent disposition.

10 Claims, 11 Drawing Figures

20
22
24
30
32
28
34
36
50
44
52
54
56
58
60
62
72
74

REJECT MECHANISM FOR BOTTLE CAPPING MACHINE

BACKGROUND OF THE INVENTION

Field of the Invention

The present invention broadly relates to capping and sealing of bottles or vials adapted to contain a medicament wherein the vials are advanced from conveyor means through an accelerating and spacing screw feed device for the bottles which are operatively placed in pockets in starwheels for passage into and through a capping assembly. The capping assembly includes an automatic cap feed for a plastic FLIP-OFF cap and after placement of a cap, sealing is accomplished and the so-capped and sealed vial is then, according to a plurality of set standards either placed on a discharge conveyor or rejected and passed to a rejection container, the control being governed by a seal test monitoring device which has acceptance or rejection information transmitted as electric signals to energize or non-energize through solenoid actuator means a high speed rejection device according to the invention.

Machines of this general nature have heretofore been known in the art. The known types of machines, however, have had speed of operation limitations dependent on bottle or vial size. Prior known devices have required substantial replacement of parts in order to accommodate bottles of different sizes.

The prior mechanisms due to complexity and structure have been incapable of reaching high speeds in capping, sealing, selection of bottles failing to meet preset requirements, and to reject or accept the completed vials all in a very high speed operation, the machinery otherwise requiring a substantial dismantling and replacement of parts in the acceptance and rejection mechanism to accommodate different vial sizes and caps.

Incorporation of mechanisms for handling of different sizes of vials has, therefore, not only been cumbersome, but substantial down time was required for replacement and/or readjustment of parts.

OBJECTS OF THE INVENTION

The present invention overcomes problems existing in previously known machines for capping and sealing of vials or bottles containing medicaments, especially when it is required to accept or reject finished or completed capped and sealed bottles in a high speed operation.

The device of the present invention is readily incorporation in a machine which feeds filled and stoppered bottles into a capping and sealing machine, and which includes means for selectively accepting or rejecting the so acted on vials or bottles depending upon a preset acceptance or rejecting mechanism operated by preset information governing present rigid requirements. In the present invention use is made of a seal force monitor which incorporates micro-processing technology to provide in-process verification of seal integrity during the pharmaceutical packaging operation by a capping machine, which in the present application is shown as being constituted by a "WESTCAPPER".

The seal force monitor is designed to accurately determine a total force required to crimp a cap on a vial and the present invention serves to reject vials not falling within the preset force tolerance range. The seal force monitor further picks up or notes defects identified by the process including missing caps, stoppers or liners, broken glass, defective glass finishes that may have broken during capping, and vials requiring excessively high or low capping forces determined by minimum and maximum preset specifications. A seal force monitor can be used for quality assurance or quality control validation, continuous automatic monitoring and inspection of seal integrity or for set-up and adjustment of vial sealing equipment. The seal force monitor as incorporated in the present overall machine is only generally described herein functionally, the details of the machine being the subject of pending patent applications.

The machine of the present invention is adapted to stack feed bottles which are picked up by a screw feed and gradually accelerated into an intake star in a smooth high speed movement of bottles devised to eliminate "slapping" problems and/or also prevents spillage of liquid product in this portion of this device. The bottle is thereafter passed under a cap feed where it picks off a cap. Then the bottle, with the cap thereon, is suspended between a pressure block and a turntable bottle rest. The bottle turns freely about its own axis and against a stationary semi-circular sealing rail mounted concentric to the turntable which performs the sealing operation.

A hopper and cap feed is shown in greater detail in U.S. Pat. No. 3,414,112, owned by a common assignee with the present application and invention, the hopper being designed to handle so-called WEST caps, or others, both lined and unlined, at high speeds required for an efficient operation. This includes a hopper bin of large capacity and a selector arrangement providing very little agitation to a small amount of caps at a time. Vibrator means drive the hopper and an electronic control, with a separate vibrator and control for the bin are provided. Both are used to regulate the flow and assure proper speed of the caps.

The present device is adapted for adjustments to handle from, for example, 60 to 600 bottles per minute.

The acceptance or rejection concept, and use with bottles or vials of different sizes or specifications, do not require that the existing machine be substantially modified. A simple removal of a nut, and removal of a starwheel, which is replaced with a new or different starwheel to accommodate functionally different vials or bottles depending upon diameters, etc., thereof is all that is required.

The actuation of the present device is devised for an extremely quick action, and must serve its function to accept or reject a bottle, and be free from interference with a next succeeding bottle.

It will appear from the foregoing and the following disclosure and description of a preferred embodiment of the invention that the present machinery not only incorporates previously known mechanisms of a common assignee, but further serves in combination to provide for high speed accurate operation of filling, capping, sealing and selection of proper bottles, or rejection of improper bottles, in a simple and high speed manner.

The present invention teaches a new and highly efficient mechanism and method for handling and testing of filled bottles, with a very efficient monitor of preset requirements for governing the acceptance or rejection of the vials.

Basically summarizing the selective bottle reject system of the invention, there is provided a high speed mechanism for selecting one or more vials from a series line of vials being driven in a given spaced relationship. A selective signal is sent to the mechanism at a time when the selected vial is in a position in the mechanism wherein gripper fingers are activated, consequent to the signal, and the gripper fingers are movable to grip a vial to be selected for discharge. The gripper fingers are operated by a cam selectively positioned by a signal from the monitor device, and the gripper fingers are designed to snap around and hold the vial as long as desired. A secondary cam is used to drive the gripper fingers back to a normal position at a time or place in the cycle when it is desired to release a selected vial and deposit it into an appropriate special path. The secondary cam is also devised to include a short movement of the gripper fingers for assuring release of non-selected vials into a selected pre-arranged path.

As will appear from the application, the present invention teaches a very advanced and efficient operation for the treatment of filled, capped and sealed bottles by means of appropriate control and signalling methods by means of a seal test monitoring device having built-in memory for controlling the apparatus.

SUMMARY OF THE INVENTION

The present invention, as will appear in more detail hereinafter, teaches a new overall machine for capping and sealing of vials filled with medicaments, and incorporates means devised to select vials which meet specific requirements or standards and pass them along for subsequent manipulation, or if the standards are not met, to then direct the vial which is improper to a discharge chute or mechanism for subsequent disposal thereof.

In effecting the overall mechanism some known parts or features are utilized, but the acceptance and rejection modes and means for actuation thereof are new. Features of the improvements will be more clearly defined by the following specific description of a preferred embodiment of the invention, it being understood that variations in detail can appropriately be incorporated into the mechanism and heretofore known and used mechanisms are incorporated in the overall system.

BRIEF DESCRIPTION OF THE DRAWINGS

The accompanying drawings illustrate preferred embodiments of the invention, and when taken together with the following description, serve to explain the principles and the structure of the invention. In the drawings.

Figures 1, 2A, 2B:
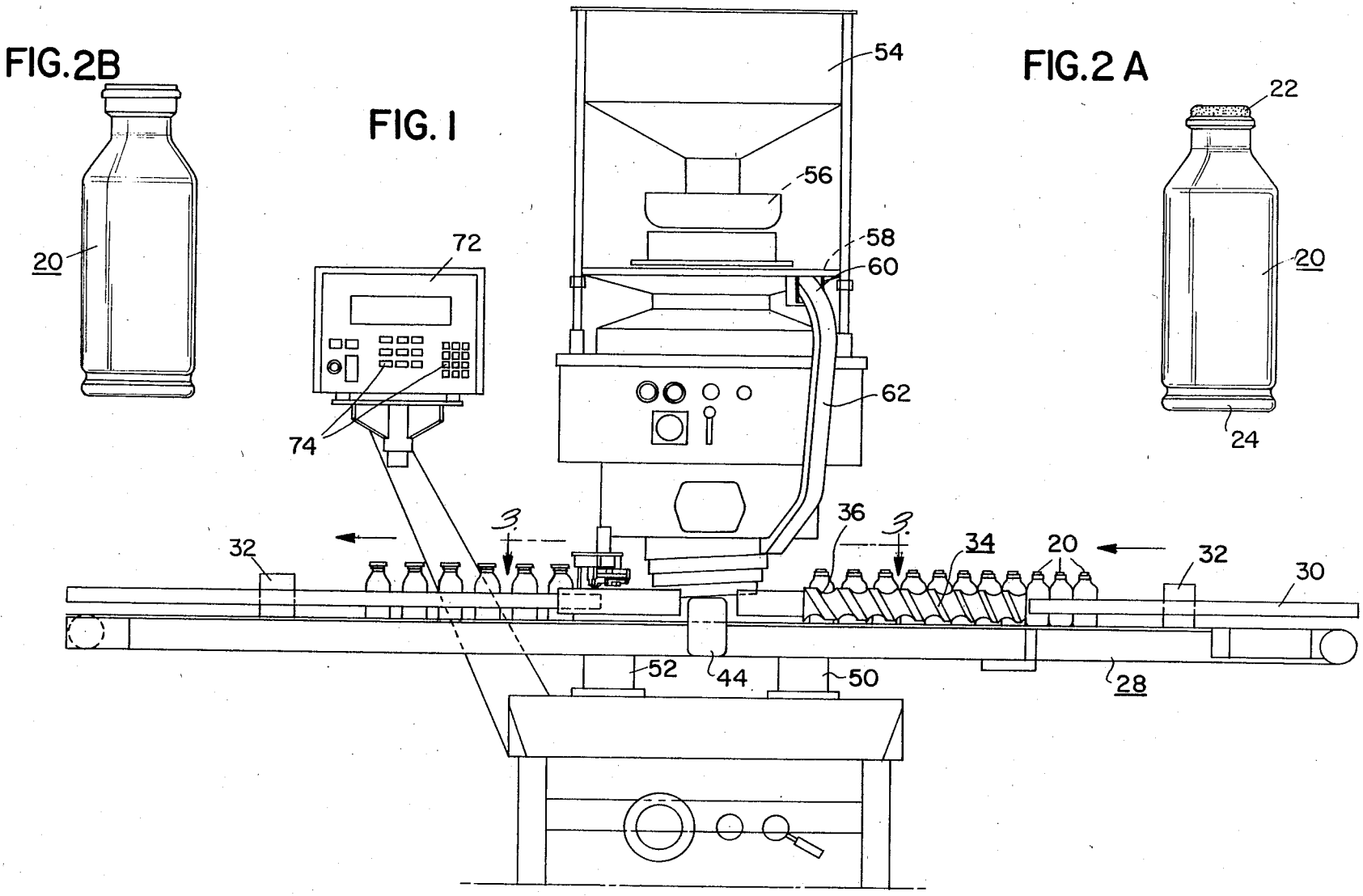
FIG. 1 is a semi-schematic fragmentary front elevational view of a vial or bottle capping seal force monitoring machine and incorporating a high-speed rejection device in accordance with the invention.
Figure 3:
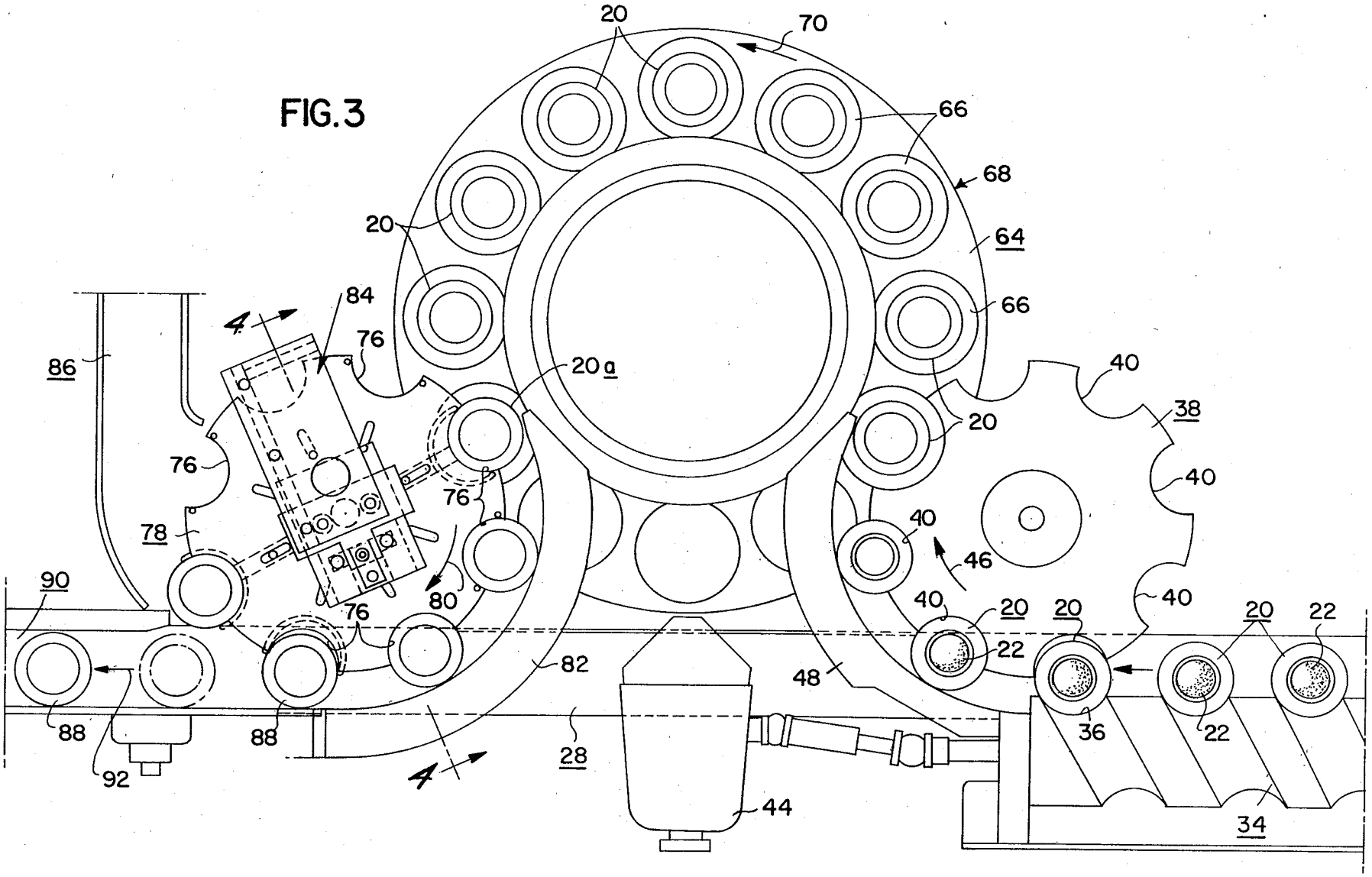
Figure 4:
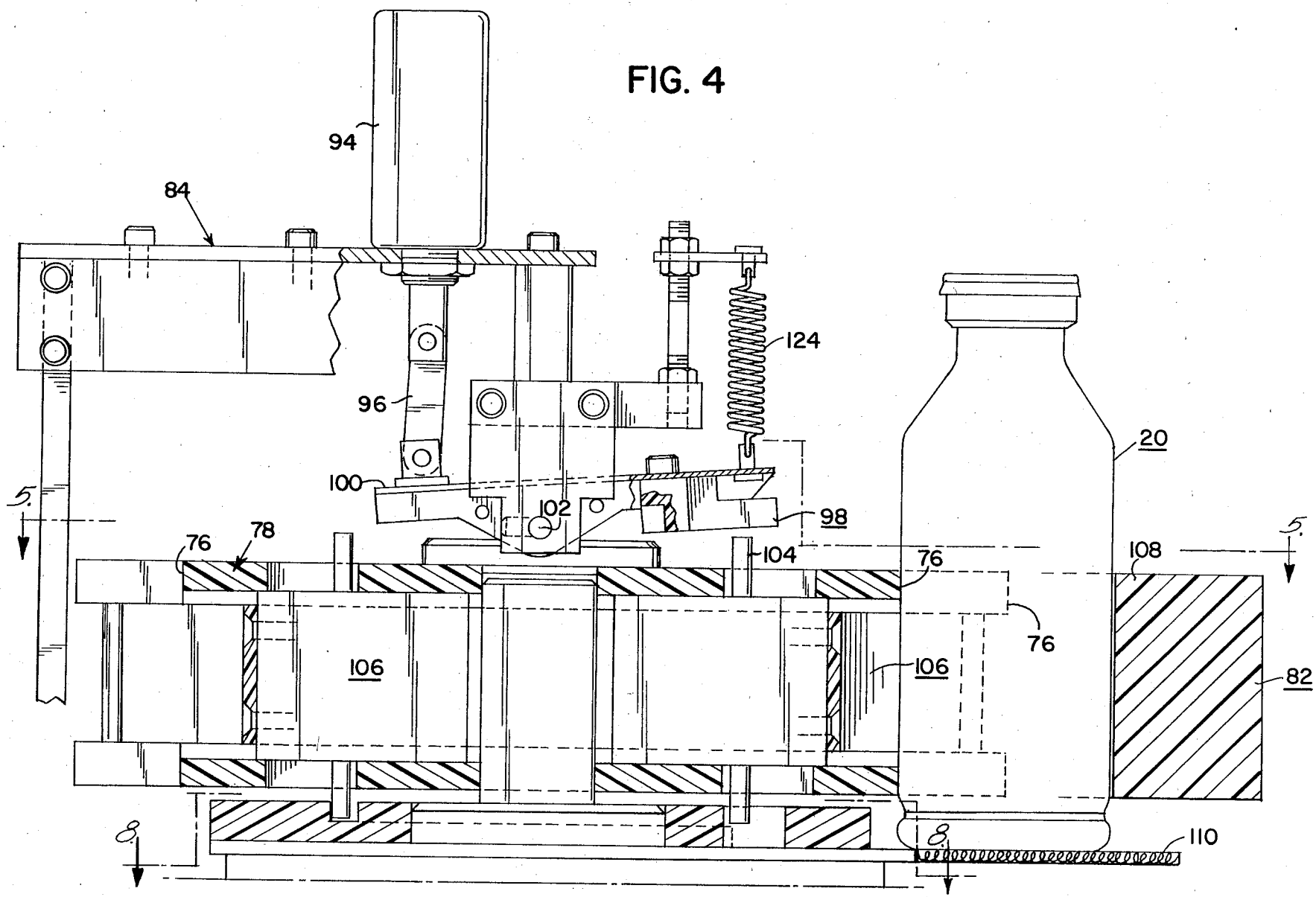
Figure 5:
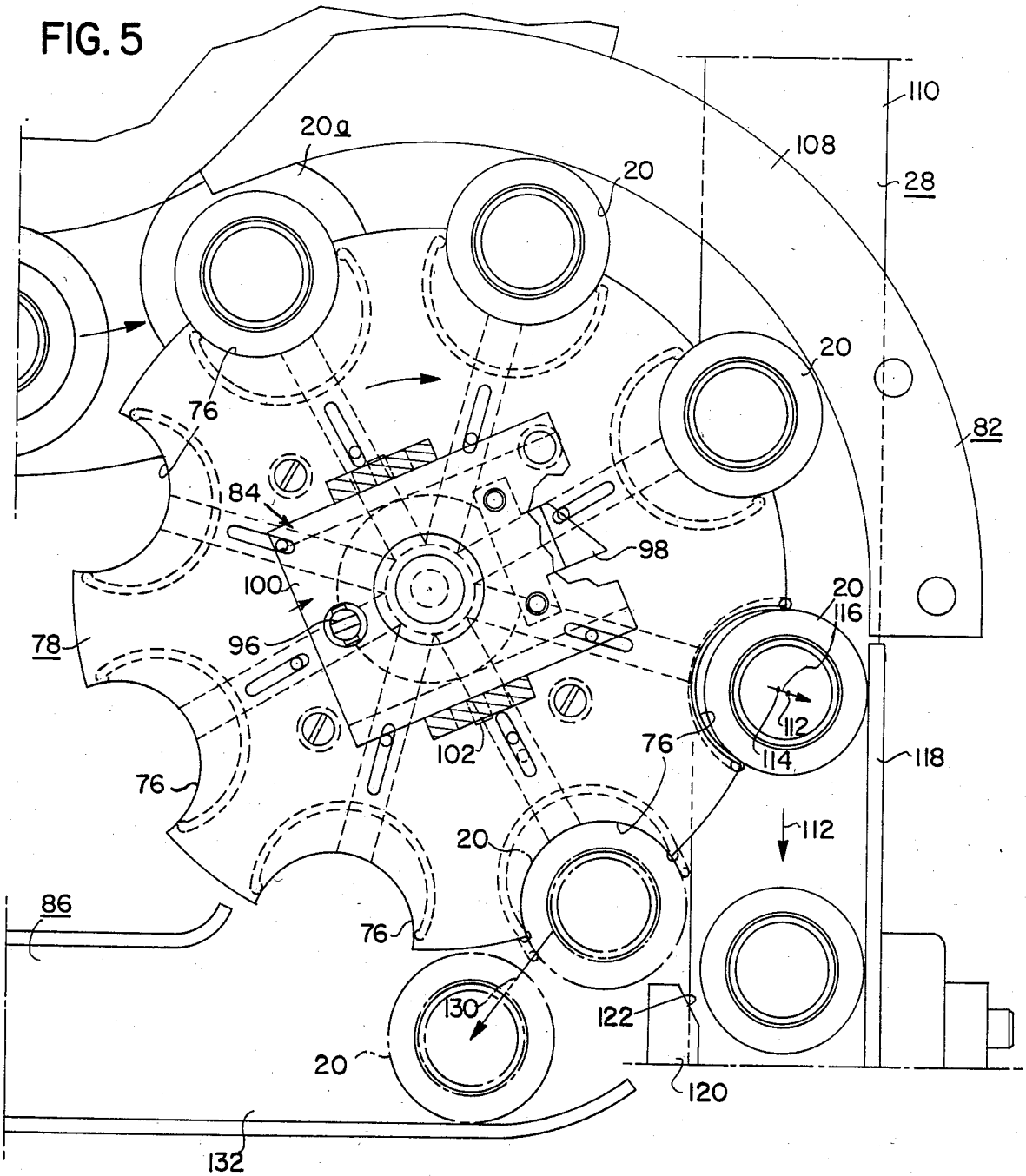
Figure 6:
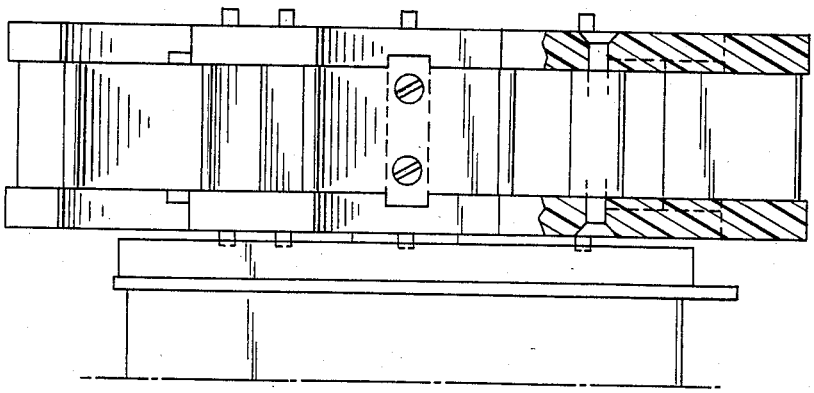
Figure 7:
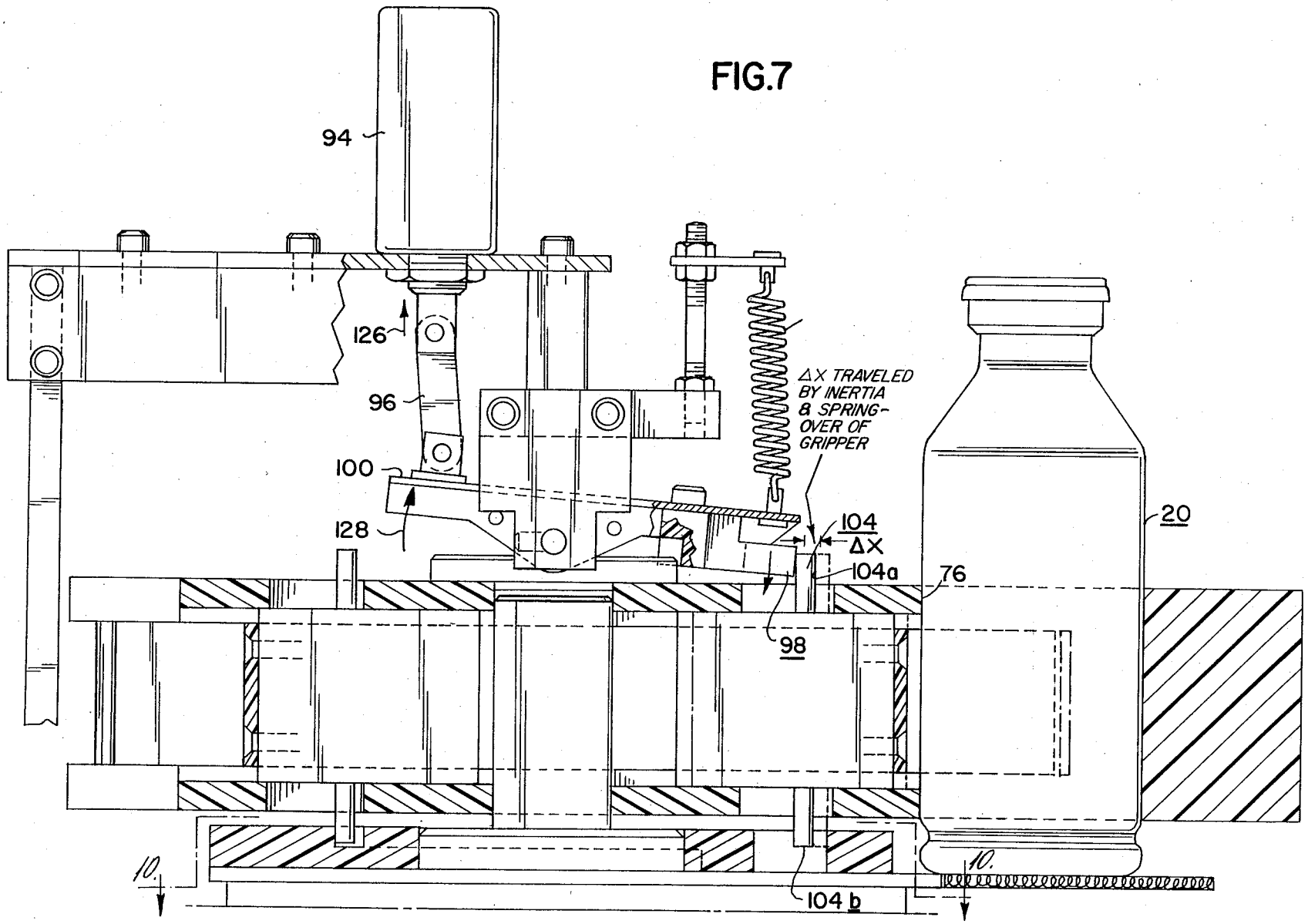
Figure 8:
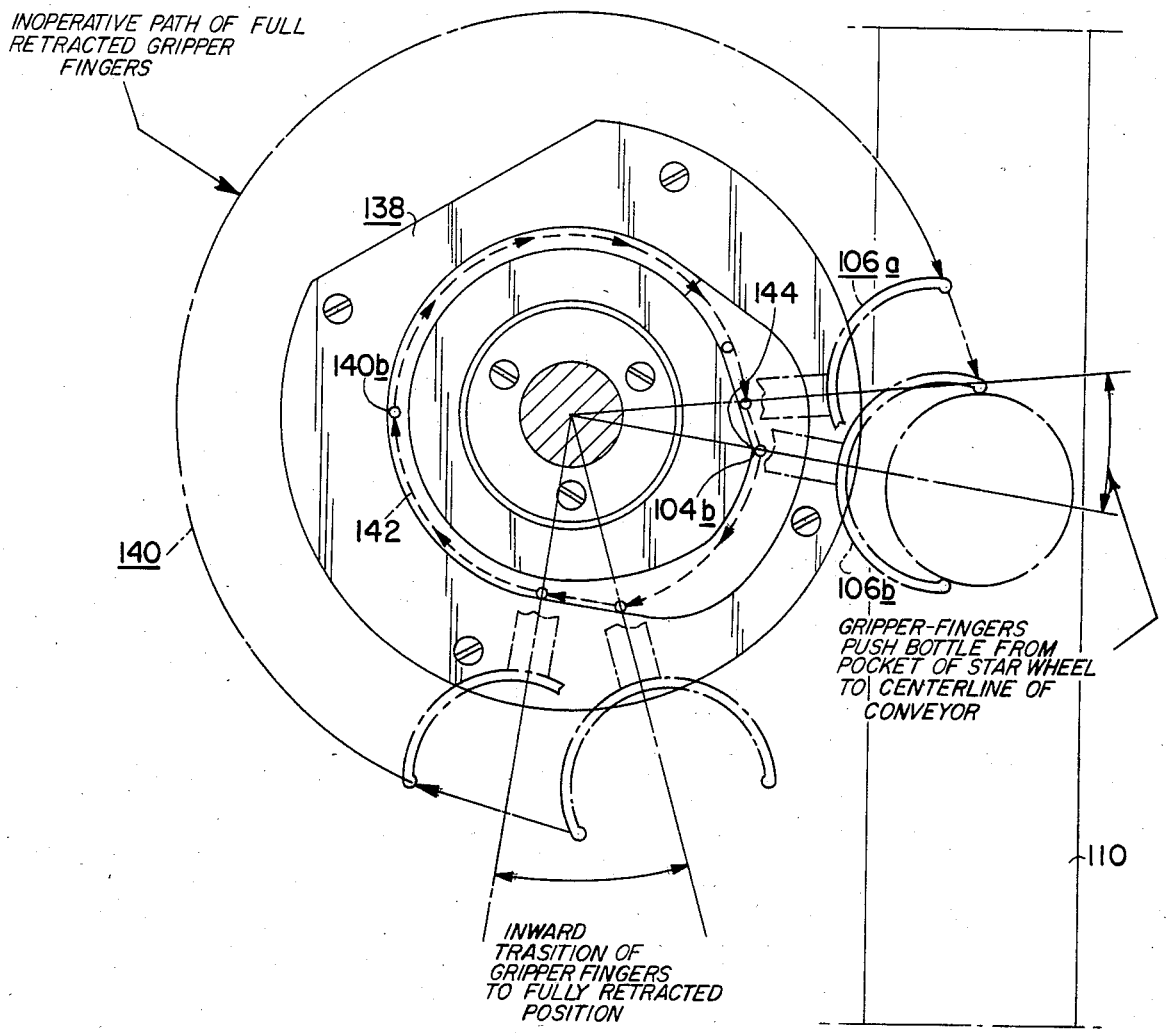
Figure 9:
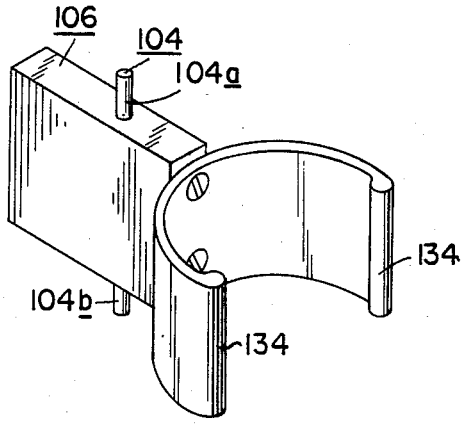
Figure 10:
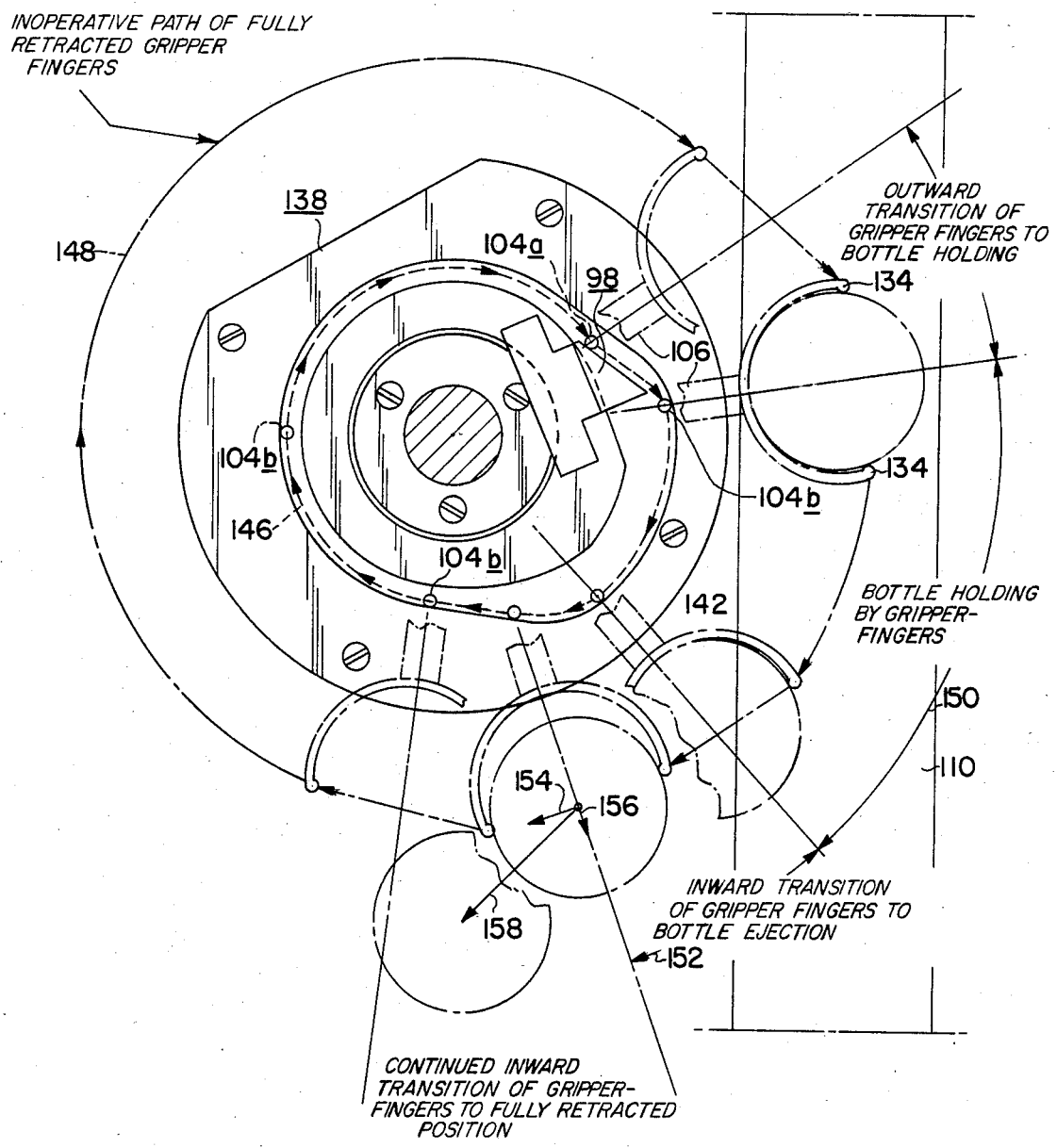

FIG. *2a* is an elevational view of a bottle to be capped, containing a medicament, and having its open apertured end sealed by a resilient stopper;

FIG. *2b* is an elevational view similar to FIG. *2a* showing the bottle after capping and either accepted or rejected subsequent to overcapping with a metallic overcap, the seal force monitor controlling the acceptance or rejection of a bottle being overcapped;

FIG. 3 is an enlarged fragmentary plan view taken on line 3–3 of FIG. 1, and showing details of a bottle infeed accelerating and spacing screw mechanism, an infeed starwheel, a bottle capping turret, an output starwheel and an associated rejection device and conveyor together with a rejected vial discharge chute;

FIG. 4 is an enlarged side elevational view taken on line 4–4 of FIG. 3, portions being broken away and in section, showing details of the rejection device, associated starwheel and underlying cam member in an inoperative mode;

FIG. 5 is a fragmentary sectional plan view taken on line 5–5 of FIG. 4 showing in greater detail portions of the rejection device and output starwheel;

FIG. 6 is a fragmentary side elevational view of the output starwheel showing additional constructional details thereof;

FIG. 7 is an enlarged elevational view, with portions broken away and in section, similar to FIG. 4 and showing the rejection device in an operating mode;

FIG. 8 is a sectional plan view taken on line 8–8 of FIG. 4 and showing in broken lines the locus of cam followers of the gripper fingers in an inoperative or non-rejection mode;

FIG. 9 is a perspective view of one of the gripper fingers and associated mechanisms; and FIG. 10 is a sectional plan view taken on line 10–10 of FIG. 7, similar to FIG. 8 but showing the locus of the gripper finger cam follower in an operative rejection mode implemented by actuation of rejection mechanism causing a cam follower deflection member to change the path of the gripper fingers.

DESCRIPTION OF THE PREFERRED EMBODIMENT

Referring now to the drawings, it is to be noted that FIGS. 1–8 disclose the inoperative or conventional mode of operation of the machine, wherein the machine is not required to conduct any function other than a known method of gently nudging or moving bottles into and out of pockets in starwheels while performing functions thereof. Broadly speaking the feed means for the bottles consist of a screw feed wherein the speed of movement of a bottle is such as to correspond with the function and mechanism of starwheel feeds, and for an accepted normal function of sealing, capping and discharge of the capped and sealed bottle.

FIGS. 5, 7 and 10 are directed to a rejection mode wherein the seal test monitor determines and indicates that a bottle is to be rejected for not meeting pre-established criterions. The test monitor serves to send an energizing signal to a solenoid control means. A rejection is selectively actuated so rapidly that subsequent bottles are not affected in any way. This is referred to as constituting a snap action of a segmented cam, and will deactivate the rejection mechanism at extremely high speeds of operation of, for example, up to 600 bottles per minute, depending on the size thereof.

The device is readily adaptable to existing machines without affecting the function of the existing machine and the starwheel feeds can be removed and replaced very simply and easily to accommodate different bottles and no other changes are required.

The overall mechanism is useable in connection with constructions of bottles or vials shown at FIGS. *2a* and *2b*. FIG. *2a* shows a standard known bottle 20 which can vary in size and dimensions as known in the art, and having a discharge orifice therein closed by an elastomeric stopper 22. A base 24 is incorporated in the bottle in a known manner. In FIG. *2b*, the bottle 20 is shown as having an aluminum skirt or overcap applied over the elastomeric stopper and which in operation through the sealing machine has picked up a cap from a cap feed, dropped it on the bottle, and the bottle is then rotated and coacts with a means to finalize the capped and sealed bottle. The bottle as shown in FIG. 2*b* can, however, fail to meet some pre-established criteria and the present invention is specifically devised to note such a failure, and to reject a vial not meeting criteria without disrupting the operation of the overall machine. The machine includes a single continuous conveyor belt 28 of a known type, and in conjunction with which guide means 30 are utilized. A shut down sensor 32 serves to sense bottle outputs and to stop the conveyor when bottles begin to stack up at the point of the sensor. This serves as a control input of a bottle feed, and serves to shut down flow of additional bottles.

The feed mechanism broadly includes an accelerating screw feed device 34 into which each individual bottle is fed, picked up, and movement thereof accelerated due to the configuration of the screw feed. This not only serves to accelerate the bottle feed speed, but also spaces the bottles one from another an appropriate distance, indicated at 36, for correlation and placement of individual bottles in a bottle pick-up starwheel. The accelerating and spacing screw feed is governed by a varied pitch. This spaces and fits bottles into spaced pockets of the starwheel. The bottle pick-up starwheel 38 is shown in FIG. 3, which includes, in a known manner, a plurality of spaced bottle receiving pockets 40, and which is mounted for rotation by drive means through an appropriate transmission which can be part of a sealer machine. Such transmission will also provide rotary motion to an output starwheel as will be shown hereinafter. A screw feed drive box 44 is shown operatively interconnected with the screw feed.

As shown in FIG. 3, stoppered bottles 20 are inserted into mating pockets 40 during operation of the machine, and as the starwheel progresses in the direction of rotation indicated as clockwise by arrow 46, the bottles are positionally maintained by means of a guide rail 48. The stoppered vials mesh and engage with the pockets of the starwheel at a position prior to the vial becoming captive by the guide rail. Once the vials are transferred to the scallops or pockets in the starwheel, they will be locked in position by the guide rail 48. A transmission 50 for the pickup starwheel is shown in FIG. 1, and an output transmission 52 for the output or discharge starwheel.

In FIG. 1, there is shown a hopper 54, which contains aluminum caps with plastic FLIP-OFF tops as used by the assignee company of the invention. Vibrator means 56 serve to place the caps on a platen or tray 58, and an exit tube 60 positions the open end of a cap to drop onto the top of a stoppered bottle of a type as shown in FIG. 2*a*. The discharge chute is designated 62. A turret capping assembly 64 underlies the starwheel. The rotatable platen or disc is synchronized for rotation with respect to the starwheel, and the rotating turret underlies the starwheel.

In a known manner, the bottles are mounted on discs 66 which rotate or spin, and, therefore, rotate the bottles. The bottle with a metal cap thereover is spun in a known manner to apply the bottle cap skirt to the bottle, with the disc rotating and raising the bottle in a known manner at station 68. At this point a cam ring controls position of this pressure block. A resultant force is obtained between the upper surface of the bottle rim and the undersurface of the metal overcap, providing a predetermined sealing force. The structure and operation of the rotatably spaced discs 66 and the sealing function are known in the art.

As the table rotates, as shown by arrow 70, the sealing force is monitored by a seal test monitoring device generally shown at 72. As heretofore pointed out, the seal force monitor is the subject of a presently pending application for patent. It includes, broadly, a computer which has memory built in, or storing means, by input buttons 74. The seal test monitoring device tests the force of the capped and sealed bottle at six points around the rim. These forces are then compared in the monitoring device with set-in criteria information of a perfect condition seal or control. The apparatus is structured to measure tolerances imparted into the memory to accept or reject capped and sealed bottles at a rate up to 600 bottles per minute, for example. The so-worked-on bottles, subsequent to sealing and monitoring, are then passed into a pocket or scallop 76 in a take off or output starwheel 78. The bottles, from a position indicated at 20*a*, following sealing, rotate on the take off or output starwheel, as indicated by the direction arrow 80. The bottles are maintained in trapped position by a rail guide 82. If the sealed bottles meet with all of the criteria built into the seal test monitor, they are accepted. Those bottles which are to be rejected are acted upon in the rejection device 84, as will be described in greater detail hereinafter, and discharged into reject chute 86, and travel therealong to collection means of any type desired. Those bottles meeting all requirements or criteria in the monitoring device are discharged from the pockets of the take off or output starwheel 78 as indicated at 88, and pass along acceptance chute 90 for placement in desired containers for shipping or the like. This movement is shown by arrow 92.

Reference is now made to FIG. 4 wherein the mechanism is in a non-rejecting or inactive mode. The acceptance or rejection mechanism includes a solenoid 94 adapted for actuation by electronic signals from the seal test monitoring device. Upon operation of this signal, the solenoid 94 raises up a connecting link moved to a lowered position, since arm 100, which carries the segmented cam 98, is 96 in such a manner that a segmented cam 98, is pivoted on a shaft 102. When segmented cam 98 is locked or lowered, it is in camming engagement position with a succeeding or next one of a series of pins 104. Each of these pins is associated or connected to a gripper finger 106.

Functionally the segmentes cam 98 pushes pins 104 and gripper fingers 106 radially outward, so that the gripper fingers 106 wrap around the vial 20 as the vial passes rails 82. In normal operation, FIG. 4, the gripper fingers are not moved outwardly by the segmented cam 98 and thus the vial moves past the rail 108 and onto a discharge conveyor 110. The action of the gripper finger is seen in the inoperative mode in FIG. 4, where the fingers have not been pushed outwardly to a position where they will pass over the center line or largest diameter of a vial. A bottle movement line is shown in FIG. 5 at 112, and a pocket line at 114. In an accepted bottle, the vial or bottle has been moved out of a pocket of discharge starwheel a distance indicated at 116, and since free of the gripper fingers, can be discharged onto the accepted vial conveyor 110.

A guide rail 118 in co-action with guide rail 120 coact to form an accepted vial path with an entrance point 122. In the condition shown in FIG. 4, the fingers 106 are inactivated. The segmented cam 98 has been pulled upwardly by spring 124 which is a tension spring. The segmented cam 98 is accordingly raised up and the various mechanisms are so conditioned as to function freely with the accepted vials being discharged onto the acceptance output conveyor. Another method of describing this is that the reject mechanism is inoperative due to the withdrawn position of the gripper fingers, and the bottle is allowed to pass as in normal operation through FIG. 8 of the drawings. It is accordingly seen that if the selective mechanism is designed as a means of selecting reject vials, good vials would leave the machine via the discharge conveyor 110.

If, on the other hand, the segmented cam 98 is moved into the active or reject position shown in FIG. 7, non-selected vials will move onto a discharge chute 86, FIGS. 3 and 5. Here the solenoid 94 has been so actuated as to move connecting link 96 as indicated by arrow 126, which raises arm 100 as shown by arrow 128. This will serve to lower the opposite end of arm 100 to stress the tension spring 124. In order to distinguish, there are two sets on gripper finger assembly 106, the upper of which is designated 104*a* and lower pin as 104. In the active or reject position shown in FIG. 7 the movement of pin 104*a* is shown as having travelled a distance $\Delta x$ by spring fingers 134 of gripper 106. This movement outwardly of the fingers places them in an operative mode, and at this point the gripper fingers will have passed beyond the center line of the bottle 20 as shown in FIG. 5. The bottle, as so gripped by gripper fingers 106, will be held in the pocket beyond the entrance 122 of the acceptance chute, formed by absence of a wiper blade at guide rail 120, and the bottle as so contained will then pass as shown by broken arrow 130 into the rejected bottle chute 132.

At this point it is considered desirable to discuss in greater detail the gripper fingers and their mounts and actuation. The gripper fingers 106 include rounded free end member 134, which conjointly are biased inwardly toward one another by the configuration of the overall finger member 106, which is mounted by means of screws at 136. As will be seen the pins 104*a* extend above the upper surface or face of gripper finger 106 and are only intermittently operated on by segmental cam 98, which is computer controlled and solenoid actuated, whenever a particular bottle is to be rejected.

FIG. 8 shows an underlying cam in the nature of a dual track, the underlying being designated 138. The inoperative path of the fully retracted gripper fingers is indicated in the broken line circle 140, and the path of pin 104*b* is indicated by the broken line circle 142. The pin 104*b* thus has the fingers in an acceptance mode. As the pin 104*b* moves in its orbit, a small bump 144 pushes the gripper fingers 106 from a position designated 106(*a*), the inward position, to the position 106(*b*), where the gripper fingers serve to push the bottle out of the pocket of the starwheel to the center line of the conveyor 110. This slight outward or supplemented movement facilitates discharge of the bottle from the pocket.

The reject mode is shown schematically in FIG. 10. The segmented cam 98 here engages with the pins 104*b* by means actuated by solenoid 94. The normal retracted position is indicated at 146 by broken lines and arrows. The inoperative path of the fully retracted gripper fingers is shown at 148. The shape of the cam 98 moves the gripper fingers to an outward position as shown in FIG. 10, depicting the rejection mode, with the end portions 134 of the finger gripper having passed beyond the center line of the bottle. In this relationship the bottle is held within the pockets of the output or take off starwheel, the bottle holding time interval or distance of rotation being indicated at 150, and designates bottle holding by gripper fingers. The outward transition of the gripper fingers to this bottle holding position is also designated. Subsequent to this gripping path or distance, there is an inward transition of the gripper fingers to bottle ejection condition 152. At this point in time, the velocity of the bottle indicated at 154, and a spring squeeze force 156, give a resultant path of a discharged bottle as at 158 caused by a continued inward transition of the gripper fingers again to the fully retracted position.

It will be seen accordingly that if the segmented cam 98 moves the gripper fingers outwardly, and captures a vial, the grippers would hold onto the vial during that time that the vial is transferring over the discharge conveyor 110. The vial would continue around with the starwheel until such times as a cam 138 located beneath the starwheel moves the pins or pin ends 104*b*, which extend out on the bottom side of the starwheel, into a retract motion, as the gripper fingers are schematically shown. When the gripper fingers are retracted a distance sufficiently to position the gripper fingers less than half way around the vial, the spring action of the closing gripper fingers will tend to snap the vial forward to a position between the conveyor's discharge point and the input transfer point from the main mechanism, this point being determined by the contour of the cam located below the upper starwheel.

In many instances, particularly due to vial tolerances, vials hang up or will get stuck in the scallops or pockets of a starwheel. In most cases, wipers, at the normal point of discharge assure that the vials are removed from the pockets. Since the present mechanism has two discharge points, it is impossible to use a fixed wiper. For this reason, the cam located below the starwheel is designed in such a fashion that the gripper fingers are moved out a short distance by the lower pin 104*b* at a position when the vial is on the discharge conveyor. As a result, if the gripper fingers are moved out in a position shown, they are timed to move the vial from the pockets and onto the conveyor. It is critical that this movement or excursion of the gripper fingers is closely controlled since the gripper fingers should not move out far enough to engage the vial but still should move far enough to dislodge all vials from the pockets.

In order to assure that only a selected or rejected vial is to be ejected, the solenoid 94 is energized only at the selected time when the pin and the gripper fingers relating to that vial are passing the segmented cam. The time that the solenoid is energized is of very short duration so that only one pin 104*a* is operated on and the adjacent pin 104 is free to perform its own selecting function. The micro-processor determines and governs the correct pocket in which a bottle is placed for either acceptance or rejection. The pins are free to perform their own selecting function and have to move the segmental cam when the bottle is to be rejected and return pin to be properly positioned for its function, i.e., each gripper fingers is individually activated to govern accept or reject action.

As a result, it can be seen that a high speed mechanism has been achieved which only requires a very small movement of a segmented cam to perform the selective operation. Since a small movement is all that is required, this mechanism operates at very high speeds. If any other type of selector bars were utilized which would work on the vials themselves large strokes would be required of the selecting mechanism thus resulting in a much lower speed capability.

From the foregoing description with reference to the drawings it will be realized that a very new and innovative high speed functioning operation of the machine can occur and the machine can be easily modified by a mere changing of a few parts to accommodate different bottles. The speed has, as above set forth, been very substantially increased which is a highly desirable advance in the art.

Manifestly minor details in structure can be effected without departing from the spirit and scope of the invention as defined in and limited solely by the appended claims. It is to be understood that the system and apparatus of the present invention has useful application in object handling equipment other than the seal force monitoring system specifically disclosed herein.

What is claimed is:

1. High speed system and mechanism for monitoring sealed vials from a series line of vials for compliance and non-compliance with pre-established criteriae, and selectively guiding and moving selected tested vials into either an accepted or non-accepted discharge path, said system including vial advancing varied pitch screw feed mechanism for engaging resiliently stoppered vials from an advancing line thereof and increasing vial movement speed and equal spacing, a first vial receiving rotatably driven starwheel having a plurality of pockets in the periphery thereof for receiving vials discharged from said screw feed mechanism, rotational speed of said starwheel and vial discharge rate from said screw feed mechanism being operatively mated to receive the vials in said starwheel pockets, a rotatably driven table, a plurality of radially spaced discs on said table adapted for receiving and spinning vials discharged from said vial receiving starwheel, means for placement and sealing of seal caps on said stoppered vials, a seal test monitor operatively engaging capped sealed vials for determining criteriae compliance, a second pocketed output starwheel operable to receive vials from said driven table subsequent to testing thereof, resilient gripper fingers radially movably mounted on said output starwheel at each said vial receiving pocket thereon, radial slots in said output starwheel inward of each said pocket, pins operatively attached to each said gripper finger, said pins including top and bottom ends extending respectively through said slots above and below said output starwheel dual cam means operatively positioned above and below said output starwheel to radially move said gripper finger, segmented cam means being selectively engageable with said pin ends for radial movement thereof responsive to control signals from said monitor to radially extend said pins, and thereby said gripping fingers, to operatively selectively grip, in a vial reject mode, a said vial to be rejected by engagement thereof beyond the central axis of said vial and to discharge such vial into a reject path means, said dual cam means, in an accept mode, having means for radially imparting a vial pushing action to said gripper fingers without gripping said vials to aid discharge of a vial from a said pocket on said discharge starwheel to a centerline of an accept path means.

2. High speed system and mechanism for monitoring sealed vials from a series line of vials for compliance and non-compliance with pre-established criteriae, and selectively guiding and moving selected tested vials into either an accepted or non-accepted discharge path, said system including means for moving vials along a predetermined path, monitor means along said path for determining criteriae compliance, an output starwheel mechanism operable to receive vials subsequent to testing thereof and including resilient gripper fingers radially movably mounted on said starwheel at each said vial receiving pocket thereon, dual cam means operatively associated with said output starwheel to radially move said gripper fingers, cam means being responsive to control signals from said monitor to radially extend said gripping fingers to operatively selectively grip a said vial to be rejected in a vial reject mode, and to discharge such vial into a reject path means, said cam means, in an accept mode, having means for radially imparting a vial pushing action to said gripper fingers without gripping said vials to aid discharge of a vial from a said pocket on said discharge starwheel to an accept path means.

3. A high-speed system and mechanism as claimed in claim 2 wherein said gripper mechanism includes a pair of flexible fingers which securely engage an object when the gripper mechanism is actuated to said extended position.

4. A high speed system and mechanism as claimed in claim 2, including a receiving starwheel with peripherally spaced pockets therein for receiving said driven and spaced vials, a rotatable table subsequent to said receiving starwheel for receiving vials therefrom, capping and sealing means operably associated with said table, said monitoring means being disposed subsequent said capping and sealing means.

5. A high speed system and mechanism as claimed in claim 3, said output starwheel having elongated slots in said output starwheel adjacent each said pocket, pins mounted on said gripper fingers, extending into said slots and having ends thereof extending and protruding beyond the upper and lower faces thereof, and multi-acting cam means operatively associated with said output starwheel and operable upon rotation thereof to extend and retract said gripper fingers to selectively grip said vials and retain a gripping relation for subsequent release at a said predetermined disposition path.

6. A high speed system and mechanism as claimed in claim 5, said cam means being configured to move said gripper fingers into a vial contacting position but restrained from a gripping relation with a said vial, said non-gripping relation occurring when a said vial upon testing has met all acceptance criteriae.

7. A high speed system and mechanism as claimed in claim 6, said cam means operable to move said gripping fingers to a non-gripping position including a segment operable upon contact with a said pin to impart thereto a supplemented pushing movement to said gripping fingers to facilitate expulsion of a said vial from a said pocket for placement on a vial acceptance path movement means.

8. A high speed system and mechanism as claimed in claim 7, wherein said gripper fingers move beyond the point of greatest diameter of a said vial to assume a gripping position thereof.

9. A high speed system and mechanism as claimed in claim 8, said cam means being operable to retract said pins in said slots for retraction of said gripper fingers for release of a said vial for subsequent placement thereof on a selected disposal path means.

10. A high speed system and mechanism as claimed in claim 9, including a solenoid actuatable by selected signals from said monitoring means to selectively so activate said gripper fingers as to act upon a vial in a single starwheel pocket and to immediately thereafter activate said gripper fingers into a non-operating condition to eliminate interference with a subsequent vial.

* * * * *